US010507503B2

(12) United States Patent
Berendes et al.

(10) Patent No.: US 10,507,503 B2
(45) Date of Patent: Dec. 17, 2019

(54) APPARATUS FOR APPLICATION AND SUCTION-REMOVAL OF OPERATING FLUIDS IN THE INLET OF COLD ROLLING SYSTEMS INSTALLATION

(71) Applicant: SMS Group GmbH, Duesseldorf (DE)

(72) Inventors: Andreas Berendes, Kirchhundem (DE); Edgar Filk, Netphen (DE); Dietrich Mathweis, Duesseldorf (DE)

(73) Assignee: SMS Group GmbH, Duesseldorf (DE)

( * ) Notice: Subject to any disclaimer, the term of this patent is extended or adjusted under 35 U.S.C. 154(b) by 599 days.

(21) Appl. No.: 15/128,158

(22) PCT Filed: Mar. 6, 2015

(86) PCT No.: PCT/EP2015/054702
§ 371 (c)(1),
(2) Date: Sep. 22, 2016

(87) PCT Pub. No.: WO2015/144420
PCT Pub. Date: Oct. 1, 2015

(65) Prior Publication Data

US 2017/0087612 A1 Mar. 30, 2017

(30) Foreign Application Priority Data

Mar. 28, 2014 (DE) ..... 10 2014 205 805
Jul. 10, 2014 (DE) ..... 10 2014 213 401

(51) Int. Cl.
*B21B 27/10* (2006.01)
*B21B 45/02* (2006.01)
(Continued)

(52) U.S. Cl.
CPC ..... *B21B 45/0251* (2013.01); *B21B 37/00* (2013.01); *B21B 39/02* (2013.01);
(Continued)

(58) Field of Classification Search
CPC ..... B21B 45/0251; B21B 37/00; B21B 39/02; B21B 45/0284; B21B 27/10; B21B 45/0245; B21B 45/0287
(Continued)

(56) References Cited

U.S. PATENT DOCUMENTS 4,400,961 A * 8/1983 Schaming ..... B21B 27/10 72/201
4,552,003 A * 11/1985 Kolecki ..... B21B 9/00 72/201
(Continued)

FOREIGN PATENT DOCUMENTS

CN 102430577 5/2012
DE 19916762 11/2000
(Continued)

OTHER PUBLICATIONS

H. Pawelski, H. Richter, Einsatz Von Minimalmengenschmierung Beim Kaltwalzen (Use of Minimum Lubrication in Cold Rolling), Tribologie und Schmierungs Technik, 54, Mar. 2007, pp. 41-45.

*Primary Examiner* — David B Jones
(74) *Attorney, Agent, or Firm* — Abelman, Frayne & Schwab

(57) ABSTRACT

The invention relates to an apparatus (1) for the applying of and removal by suction of operating fluids onto rolling stock (2) and off rolling stock (2) in the inlet (4) of cold rolling systems (6) and comprises at least one spray device (7) arranged above or below a rolling stock transport line (8), wherein at least one operating fluid can be placed by the spray device (7) onto a surface of the rolling stock (2) or onto a surface of a working roll (9) which makes contact with the rolling stock (2), and to at least one suction removal device (10) which can be arranged above or below the rolling stock transport line (8) and on the same side of the rolling stock transport line (8) as the spray device (7),
(Continued)

Figure 1:
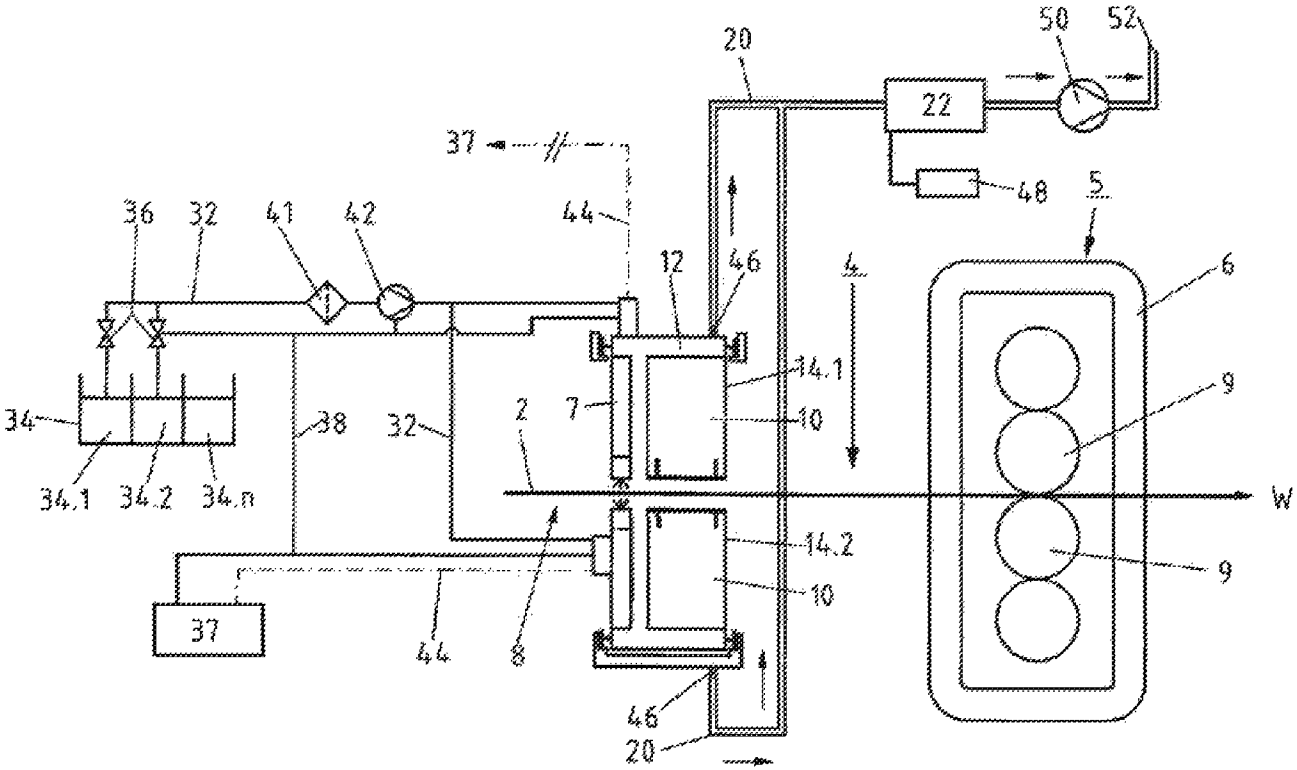

wherein the suction removal device (10) acts in the vicinity of the surface of the rolling stock (2) or of the working roll (9). The spray device (7) and the suction removal device (10) are attached onto a common component frame (12) and therefore form a compact unit (14.1; 14.2).

12 Claims, 7 Drawing Sheets

(51) Int. Cl.
*B21B 37/00* (2006.01)
*B21B 39/02* (2006.01)

(52) U.S. Cl.
CPC ..... *B21B 27/10* (2013.01); *B21B 45/0245* (2013.01); *B21B 45/0284* (2013.01); *B21B 45/0287* (2013.01)

(58) Field of Classification Search
USPC ..... 72/201, 43
See application file for complete search history.

(56) References Cited

U.S. PATENT DOCUMENTS

| | | | | |
|---|---|---|---|---|
| 4,619,126 | A * | 10/1986 | Kolecki | B21B 9/00 72/201 |
| 4,934,444 | A * | 6/1990 | Frischknecht | B21B 27/08 164/428 |
| 6,006,574 | A | 12/1999 | Armenat | |
| 7,472,574 | B2 | 1/2009 | Pawelski | |
| 8,001,820 | B2 | 8/2011 | Pawelski | |
| 2010/0101291 | A1 | 4/2010 | Richter | |
| 2010/0279127 | A1 | 9/2010 | Ukai | |

FOREIGN PATENT DOCUMENTS

| | | |
|---|---|---|
| DE | 10216685 | 11/2003 |
| EP | 0060375 | 9/1982 |
| JP | 62173006 | 7/1987 |
| JP | 04322807 | 11/1992 |
| JP | 2012125776 | 7/2012 |
| WO | 0061308 | 10/2000 |
| WO | 2007085613 | 8/2007 |

* cited by examiner

APPARATUS FOR APPLICATION AND SUCTION-REMOVAL OF OPERATING FLUIDS IN THE INLET OF COLD ROLLING SYSTEMS INSTALLATION

RELATED APPLICATIONS

This application is a National Stage Application of International Application PCT/EP2015/054702 filed Mar. 6, 2015, which claims priority of German applications Nos. DE 10 2014 205805.8 filed Mar. 28, 2014 and DE 10 2014 213401.3 filed Jul. 10, 2014, all three applications are incorporated herein by reference thereto.

The invention relates to an apparatus for the applying of and removal of operating fluids onto rolling stock or from rolling stock in the inlet of cold rolling systems.

When rolling stock, e.g. in the form of a metal band, it is known according to the prior art to use an operating fluid in the inlet of a cold rolling system, wherein this operating fluid is applied onto a surface of the metal band or of a working roll which makes contact with the metal band. A friction between the metal band and a working roll of the cold rolling system can be optimized by using a certain amount of operating fluid in order to achieve an improvement of the product quality. In this connection a so-called minimal amount of lubrication is known, e.g. from EP 1 925 369 B1 or EP 1 753 539 B1 according to which only a minimal amount of operating fluid is supplied onto a surface of the metal band or of a working roller, for example as a function of the process data of the rolling process. EP 1 925 369 B1 and EP 1 753 539 B1 contain no suggestions for removing residual amounts of operating fluid such as particles of oil or the like by suction which can form after the application of the operating fluid on the surface of the metal band or of the working roll in their vicinity.

DE 199 16 762 A1 and EP 0060375 A2 teach apparatuses for spraying or oiling metal bands with a fluid in which the metal band is run through a large-volume housing. Hollow wall parts and suction conduits are provided in such a housing which are connected to a suction blower. This ensures a removal by suction of liquid mist or the like. Such suction removal devices, which are always provided in combination with an entire housing, have the disadvantage of an expensive construction and of a large construction volume.

Accordingly, the invention has the basic problem of creating an apparatus for applying operating fluids onto a rolling stock and removing them from a rolling stock in the inlet of cold rolling systems, which ensures a simple construction with compact dimensions.

The problem posed is solved by an apparatus with the features of claim 1. Advantageous further developments constitute subject matter of the dependent claims.

An apparatus according to the invention serves in the inlet of cold rolling systems to apply operating fluids onto a rolling stock and to remove operating fluids from this rolling stock by suction and comprises at least one spray device which is arranged above or below a rolling stock transport line. An operating fluid can be applied by the spray device onto a surface of the rolling stock and/or onto a surface of a working roll which makes contact with the rolling stock. The device furthermore comprises at least one suction removal device which is arranged above or below the rolling stock transport line and on the same side of the rolling stock transport line as the spray device, wherein the suction removal device acts in the vicinity of the surface of the rolling stock and/or of the working roller. The spray device and the suction removal device are attached to a common component frame and therefore form a so-called compact unit.

The invention is based on the essential recognition that the apparatus for applying operating fluids onto a rolling stock and removing them from it by suction in the inlet of a rolling stock combines the essential components in a very tight space which are necessary for the application of operating fluids and their removal by suction. This includes the spray device and the suction removal device. It is essential here that the spray device and the suction removal device are attached to the common component frame, namely directly adjacent to one another. The suction removal device can be arranged here, viewed in the direction of rolling, behind or downstream and/or in front or upstream from the spray device if the operating fluid is applied onto the surface of the rolling stock. Therefore, a direct suction removal of operating fluid particles or of an oil mist arising from them is ensured by the suction removal device which acts in the vicinity of the surface of the rolling stock or of a working roller. The same applies if the operating fluid is supplied directly onto a surface of the working roll and the suction device is arranged here, viewed in the direction of rotation of the working roller, after the spray device.

It should be pointed out that in the sense of the present invention a compact unit is to be understood in such a manner that on the one hand the spray device and the suction removal device are fastened spatially at a small distance from one another on a common straight-sided frame, namely in the shape of the component frame, and that on the other hand such an arrangement of the spray device and of the suction removal device can take place regardless of a separate machine housing for the working roll or of the rolling mill. This also has the advantage of a retrofitting of already existing rolling systems.

The "rolling stock" in the sense of the invention is a metal band which can be formed either as an iron metal band or as a non-iron metal band.

The concept "operating fluid" denotes in particular lubricants such as, e.g. oil.

The concept "multi-substance nozzle" denotes in particular a two-substance nozzle.

The concept "propelling gas" denotes in particular compressed air.

A predetermined, small amount of operating fluid can be applied either on a surface of the rolling stock and/or on a surface of a working roll by the compact unit and its spray device. The amount of operating fluid applied here is dimensioned in such a manner that it moistens the surface of the rolling stock or of the working roll to the extent possible without moistening the surface too heavily. This means that the depths/recesses of the surface should not be completely filled. The measuring of an ideal amount of operating fluid is also known in the prior art as the minimal lubrication amount and to this extent requires no further explanation.

The particles of the operating fluid which do not moisten a surface of the rolling stock or of a working roll or an ambient air permeated with them are removed by suction in the vicinity of and in the direct proximity of the spray device by the suction removal device. This can effectively avoid a propagation of air loaded, e.g. with operating fluids. This prevents the system and also any operating personnel from being exposed to an oil vapor. The oil-charged air is removed by the suction device via a mist suction removal device connected to it and is appropriately treated in it. This mist suction removal device can comprise a ventilator for producing a vacuum so that the air is removed by suction by the suction removal device and suction removal conduits connected to it in the form of connection lines. In every instance the exhaust air mist is suitably worked up before it is brought together with other air currents.

The treatment of the exhaust air of the oil mist takes place according to the type of oil by a suitable filtration which can take place, e.g. by a baffle filter, an activated carbon filter, a washer or by a mixture of several of these methods. The recovered oil is subsequently collected as condensate.

In an advantageous further development of the invention a condensate runoff can be provided. The condensate runoff can be constructed inside the mist suction removal device itself, inside a connection line running to the mist suction removal or in a suction removal conduit connected to the mist suction removal device. According to another alternative a condensate runoff can also be constructed in a suction removal device of the compact unit.

In an advantageous further development of the invention the spray device can comprise at least one multi-substance nozzle from which a mixture consisting of at least one operating fluid and compressed air is discharged. The operating fluid is preferably an oil. Therefore, a finely dispersed oil mist is discharged from such a multi-substance nozzle taking into account the cited compressed air. Furthermore, the spray device can preferably comprise at least one nozzle bar with a plurality of multi-substance nozzles wherein the nozzle bar is arranged transversely to the direction of rolling. In this manner a covering of the surface of the rolling stock and/or of a working roll over its entire surface is advantageously ensured in order to achieve a uniform application of the operating fluid.

In an advantageous further development of the invention the multi-substance nozzles can be controlled individually, in pairs and/or as a group which is associated with a certain zone of the rolling stock or of a working roll over a width of it. This can influence and optimize in a purposeful manner the quality of the rolling stock locally over its width.

Figure 2:
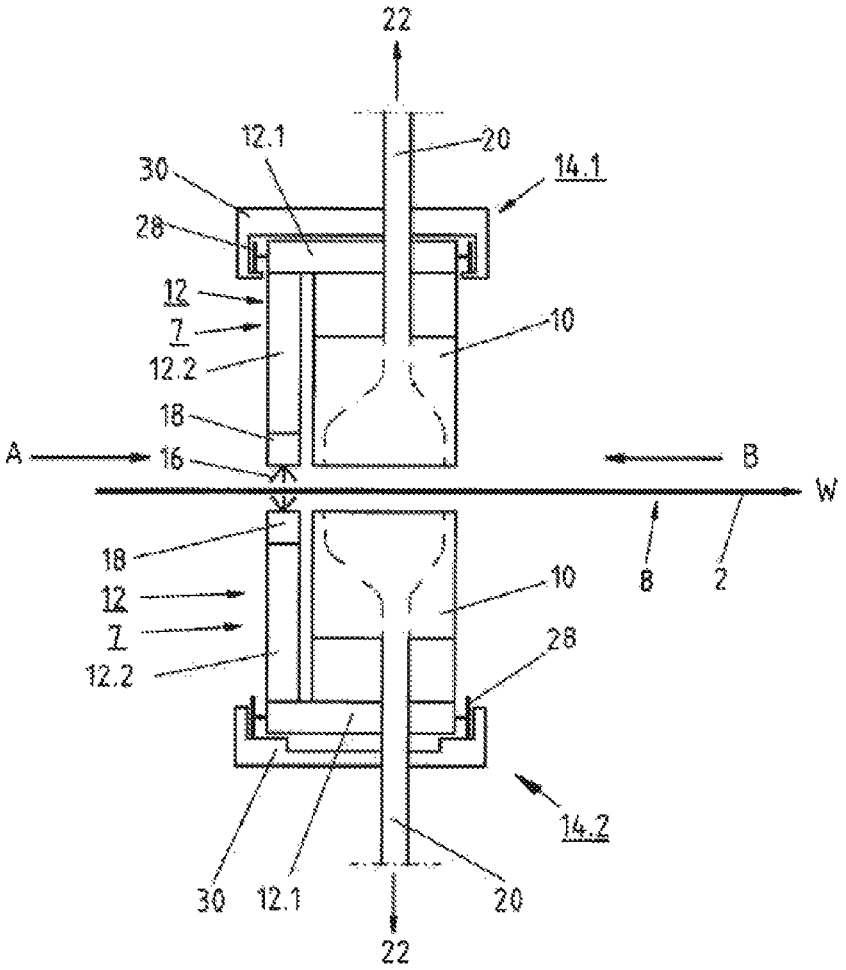
Figure 3:
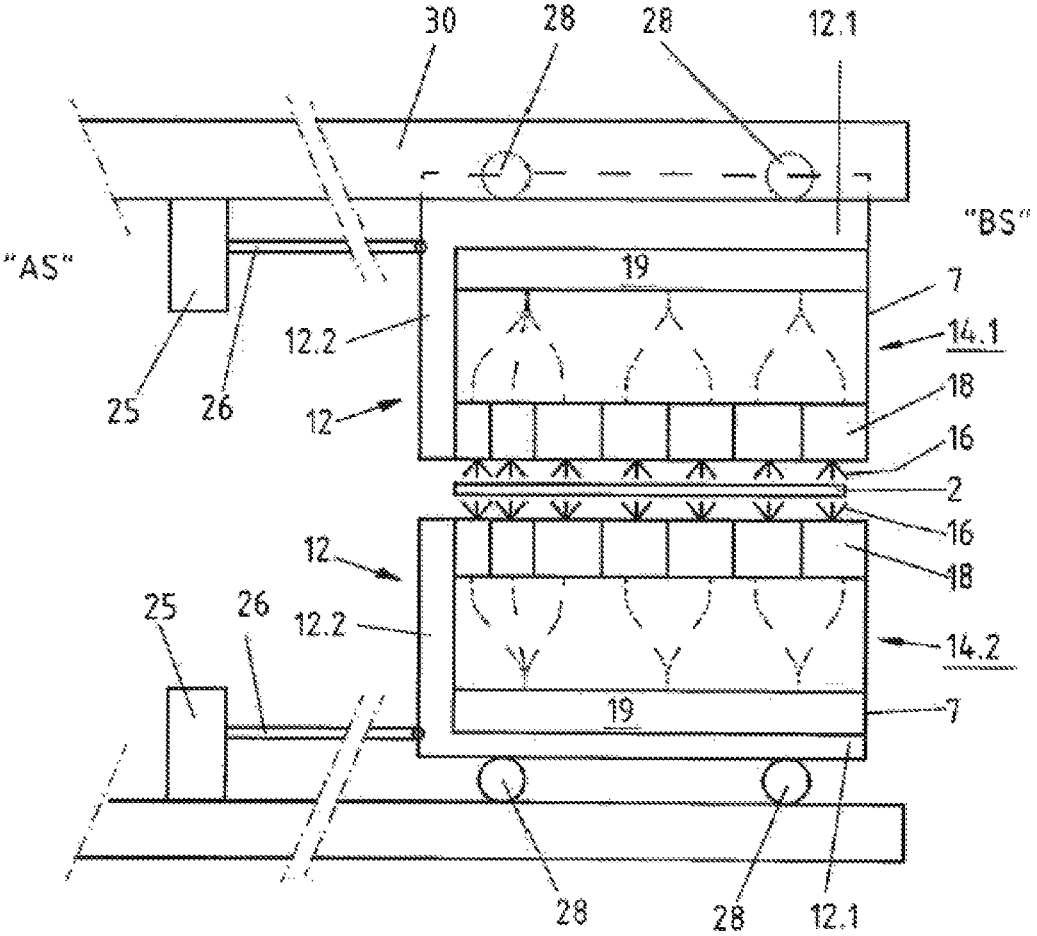
Figure 4:
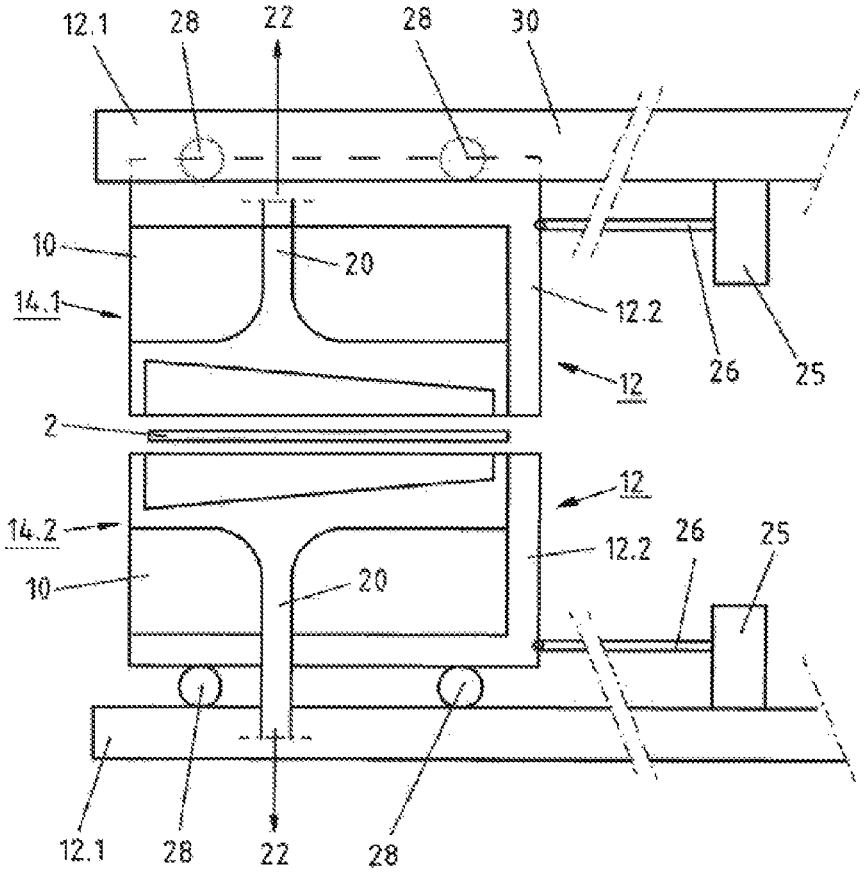
Figure 5:
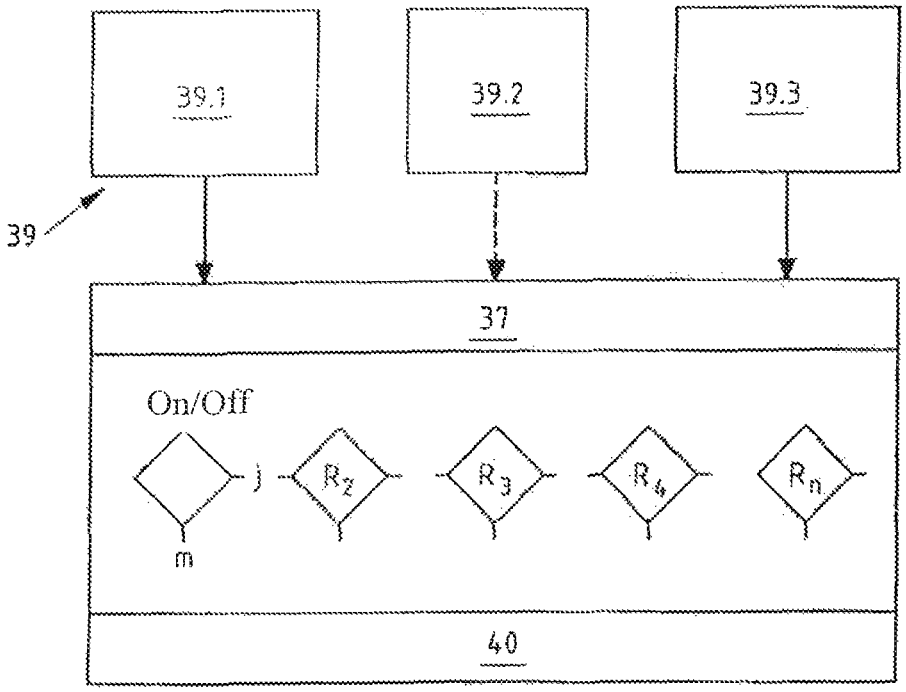
Figure 5:
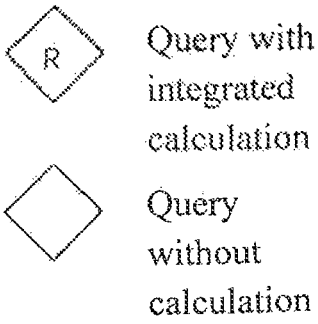
Figure 6:
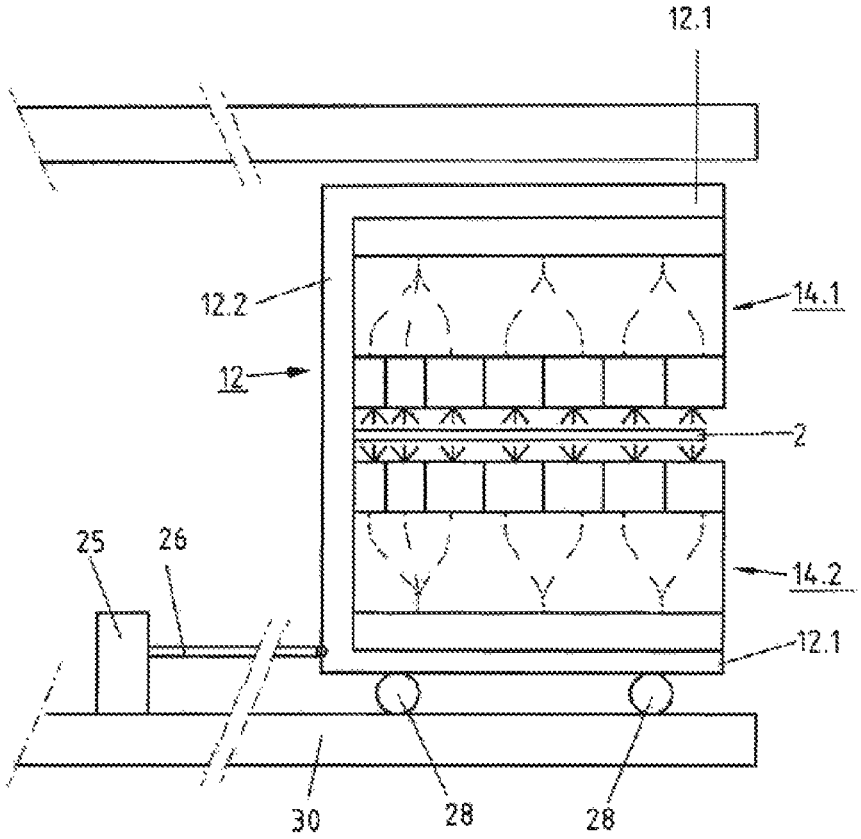
Figure 7:
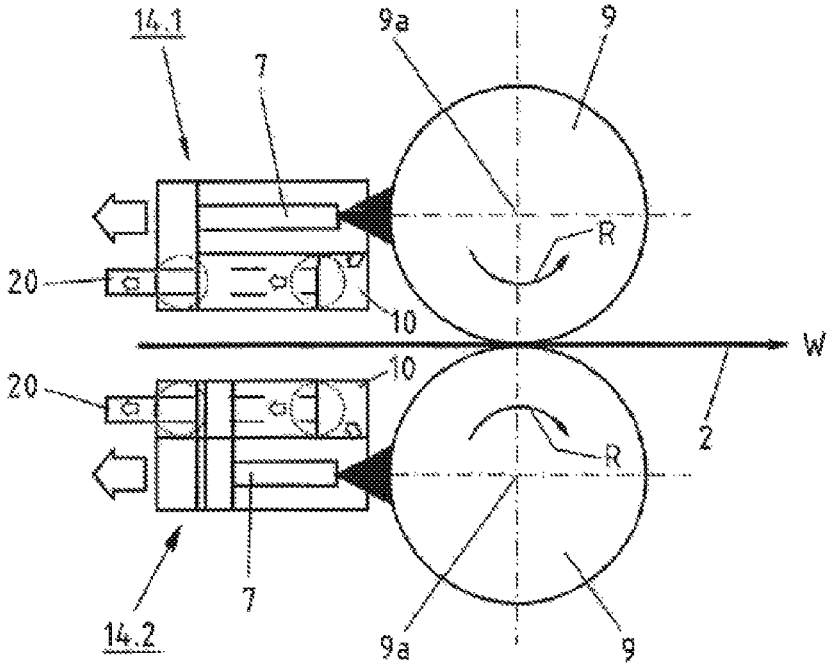

Other advantages and features of the present invention result from the following description of exemplary embodiments and from the attached drawings. In the drawings:

FIG. 1 a schematic and basically simplified side view of an apparatus according to the invention, FIG. 2 an enlarged and simplified view of the two compact units of the apparatus of FIG. 1, FIG. 3 a view of the compact units of FIG. 2 from the viewpoint of the arrow A shown in it, FIG. 4 a view of the compact units of FIG. 2 from the viewpoint of the arrow B shown in it, FIG. 5 a block diagram view of process parameters which can be considered for a device of FIG. 1, FIG. 6 a schematic and basically simplified side view of a device of the invention according to another embodiment, and FIG. 7 a schematic and basically simplified side view of a device according to the invention.

FIGS. 1 to 4 show a first embodiment of an apparatus 1 according to the invention and details of it with which an operating fluid can be applied on the surface of a rolling stock 2 and residual amounts of the operating fluid can be removed by suction from an area of the rolling stock 2 close to the surface. The rolling stock 2 can be metal bands, for example from heavy metal or light metal of different allows. The rolling stock is always designated only as "metal band" in the following.

FIG. 1 shows the apparatus 1 in an inlet 4 of a cold rolling system 5. Two working rolls 9 are arranged opposite one another in a frame 6 of this cold rolling system 5, wherein the metal band 2 is guided between the working rolls 9. Other rolls, for example support rolls of the cold rolling system 5 which are provided inside the frame 5 bordering on the working rolls 9 are indicated only for simplification and are not completely represented.

The metal band 2 is transported in the direction of the cold rolling system 5 which is designated in the following as rolling stock transport line 8. The direction of rolling is indicated in FIG. 1 with an arrow "W".

The apparatus 1 comprises an upper compact unit 14.1 and a lower compact unit 14.2, wherein these compact units are arranged above and below the rolling stock transport line 8 and adjacent to it. Details for these compact units are explained in the following with reference made to the view of FIG. 2.

The apparatus 1 comprises per compact unit a spray device 7 and a suction removal device 10 that are attached to a common component frame 12 and therefore form a compact unit. Such a design of the two compact units 14.1, 14.2 above and below the rolling stock transport line 8 is preferably selected to be identical. To the extent that other features of the two compact units 14.1, 14.2 correspond to each other, only one reference is made for a simplified explanation of them and the compact unit is generally designated with "14".

The component frame 12 of the compact unit 14 can be constructed in the shape of an L profile, namely with a base shank 12.1 and a vertical shank 12.2. The vertical shank 12.2 is directed here in the direction of the rolling stock transport line 8 and of the metal band 2. A plurality of multiple substance nozzles 16 in combination with a spray bar 18 is attached to a free end of the vertical shank 12.2. The operating fluid, preferably in the form of an oil, can be applied from the multi-substance nozzles 16 onto a surface of the metal band 2.

The suction removal device 10 is attached to the base shank 12.1 and borders on the multi-substance nozzles 16 in such a manner that the suction removal device 10 is arranged in the rolling direction W downstream or after the multi-substance nozzles 16. The rolling direction is indicated with an arrow W in FIG. 2.

The suction removal device 10 is connected by a connection line 20 to a mist suction removal device 22 and therefore has a flow connection with this suction removal device 22.

Other details of the compact units 14.1, 14.2 are shown in the FIGS. 3 and 4 which are views of the FIG. 2 from the direction of the arrows A and B shown in it.

Drive means 25 are provided for a movement of the compact unit 14 transversely to the rolling direction W which are connected for example by a piston rod 26 to the vertical shank 12.2. The drive means 25 can be a hydraulic unit or a pneumatic unit or an electronic unit, wherein the length of the piston rod can be adjusted transversely to the rolling direction W in order to move the compact unit in a corresponding manner. The base shank 12.1 is movably attached and guided by rolls 28 to a base frame 30.

The compact unit 14 can be moved laterally and transversely to the rolling direction W by an activation of the drive means 25, namely between an operating position and a non-operating position. In the view of FIG. 3 the compact units 14 are shown in their operating position in which the spray bar 18 completely covers the metallic band 2 over its width. Starting from this operating position, the compact units 14 can be moved by the drive means 25 in such a manner to the side and transversely to the rolling direction W that the spray bar 18 is positioned completely adjacent to the side of the rolling stock transport line 8. Note in this regard that the upper and the lower compact units 14.1, 14.2 can also be moved laterally even independently of one another as regards the rolling stock transport line 8.

The spray device 7 is associated with a valve box 19 in which a plurality of control valves (not shown) are provided. It is possible to supply the multi-substance nozzles 16 of the spray bar 18 with the operating fluid and optionally also with propellant gas with these control valves. In the view of FIG. 3 the connection lines between the control valves and the multi-substance nozzles 16 are symbolically simplified and indicated by dotted lines.

In the view of FIG. 3 the drive side is designated with "AS", where being an operating side is designated with "BS".

The view of FIG. 4 shows the suction removal devices 10 of the upper and lower compact units 14.1, 14.2. The suction device 10 is attached in such a manner to the base shank 12.1 of the associated component frame 12 that its associated suction opening borders directly on the surface of the metal band 2. This ensures that a residual amount of operating fluids, e.g. lubricant, oil mist or the like can be reliably removed by the suction removal device 10, namely through a connection line 20 in the direction of a mist suction removal 22. According to the view of FIG. 4 the suction removal device 10 can have the shape of a suction removal hood.

Other details of the apparatus 1 according to the invention are explained in the following with reference made to FIG. 1.

The upper and the lower compact units 14.1, 14.2 and their associated spray device 7 are connected via a medium supply line 32 to an oil reservoir 34 in which operating fluid is stored in the form of lubricating oil. The oil reservoir can comprise a plurality of tanks of which two tanks in FIG. 1 are designated by "34.1" and "34.2". Note in this regard that the number of tanks in the oil reservoir 34 is basically not limited and can be as large as desired. Another number of tanks is designated in FIG. 1 simply by "**34.*n*". Such a plurality of tanks inside the oil reservoir 34 meets the purpose of storing different oil types in them which can be selectively supplied to the spray device 7. To this end appropriate valves 36 are provided in the medium supply line 32 which can be controlled by a regulator 37. To this end the valves 36 are connected by a control line 38 to the regulator 38**.

A filter 41 and a pump 42 are installed in the medium supply line 32 in order to transport the lubricating oil from the oil reservoir 34 in the direction of the spray device 7. The pump 42 can be connected to the control line 38 so that a suitable control of the pump 42 by the regulator 37 is possible.

FIG. 1 illustrates that the control line 38 also runs to the compact units 14.1 and 14.2. Therefore, the valves inside the valve box 19 as well as the multi-substance nozzles 16 of the spray bar 18 can be controlled by the regulator 37, namely in order to supply the multi-substance nozzles 16 with the operating fluid and/or propellant gas.

A propellant gas line 44 is connected to the compact units 14.1, 14.2 through which compressed air can be supplied to the spray device 7 and the particular multi-substance nozzles 16. As a result, it is possible to discharge the operating fluid in combination with the propellant gas, e.g. compressed air, in a finely dispersed form from the multi-substance nozzles 16. In FIG. 1 the particular propellant gas lines 44 are symbolized in a simple form by dotted lines. The supplying of the compact unit 14 with propellant gas can also be adjusted by the regulator 37.

The connection lines 20 running from the upper compact unit 14.1 and the lower compact unit 14.2 to the mist suction removal device 22 are connected by a rapid connection 46 to the suction removal device 10. This rapid connection 46, shown only symbolically in FIG. 1, meets the purpose that the connection line 20 can be separated from the suction removal device 10 when the compact unit 14 is moved laterally from its operating position into the non-operating position. As an alternative to the making available of the cited rapid connection 46, the connection line 20 can be constructed to be sufficiently long and elastic so that a lateral moving of the compact unit 14 by the connection line 20 is suitably compensated.

The mist suction removal device is symbolized in FIG. 1 by the reference numeral "22". A suitable exhaust air treatment can be provided in this mist suction removal device 22, for example by using a baffle filter, an activated carbon filter, a washer or a combination of these components. As a supplement to the above, it is possible that a condensate runoff 48 is provided either in the mist suction removal 22 device or in a line connected to it, by means of which a removal of recovered oil as condensate is possible.

In order to generate a sufficient vacuum a ventilator 50 is provided which can be installed either in a suction removal conduit 52 connected to the mist suction removal device 22 (cf. FIG. 1) or directly inside the mist suction removal 22 device (not shown in the drawing).

The invention functions as follows:

In order to work the metal band 2, it is transported in rolling direction W to the cold rolling system 5. A mixture of lubricating oil and compressed air is applied onto the surface of the metal band 2, namely on its upper and lower sides at the inlet 4 of the cold rolling system 5 by the upper and lower compact units 14.1, 14.2. It is understood in this regard that for such an application the compact units 14.1, 14.2 are located in their operating position (cf. FIG. 3, FIG. 4) in which the spray bar 18 of a particular compact unit completely covers the metal band 2 over its width.

It can be provided for a purposeful supplying of the multi-substance nozzles 16 with lubricating oil and compressed air that the regulator 37 is connected by signal technology to a process databank 39 in which the theoretical value conditions for process parameters of the rolling process are stored. FIG. 5 shows such a process databank 39 in a symbolically simplified manner. Theoretical value conditions for the rolling process can be stored in a memory unit 39.1 which can include flatness, roughness, degree of preparation, taking of samples or the like. A process model 39.2 can also be provided in the process databank 39 on the basis of which model additional data can be supplied to the regulator 37. Finally, other information and/or calculations from technological regulations, simplified in FIG. 5 with the symbol 39.3 can be supplied to the regulator 37 so that positioning signals for controlling and switching conditions of the components can be outputted from the regulator 37 as the result of the calculations and inquiries. These positioning signals are symbolized in FIG. 5 with "40".

The rhombus-shaped symbols indicated inside the symbol for the regulator 37 in FIG. 5 illustrate that an adjustment can also be made by the regulator 37 to show from which tank **34.*n* of the operating fluid reservoir 34 the operating fluid is supplied by the medium supply line 32 to the compact unit 14 and its associated spray device 7. Furthermore, an adjustment can be made via the regulator 37 as a function of the theoretical value conditions about which precise amount of oil is discharged with which pressure and which amount of the propellant gas from the multi-substance nozzles 16 in order to achieve the desired moistening of the surface of the metal band 2**.

The process databank 39 shown in FIG. 5 can be made available in the form of a separate databank or, alternately, integrated into the regulator 37, which therefore represents its own calculating unit.

The regulator 37 can also adjust which amount of the propellant gas is discharged by the suction removal devices 10 in the direction of the mist suction removal device 22 in order to remove by suction residual amounts of operating fluid, oil mist or the like to the desired extent.

It is possible for purposes of repair and/or maintenance to move the compact units 14.1, 14.2 out laterally from the rolling stock transport line 9, namely into their non-operating position, by controlling the drive means 25. The upper compact unit 14.1 can also be moved independently of the lower compact unit 14.2 and vice versa.

FIGS. 6 and 7 show other exemplary embodiments of the invention. To the extent that associated features in them correspond to those of the embodiments of FIGS. 1 to 4, they are designated with the same reference numerals. Specifically: FIG. 6 shows a font side view of the apparatus 1 in the direction of the arrow A in FIG. 2, wherein in this embodiment the component frame 12 for the upper and the lower compact units 14.1, 14.2 is preferably constructed in one piece. This means that the upper compact unit 14.1 and the lower compact unit 14.2 are jointly connected to one another on this component frame 12, which comprises only a single vertical shank 12.2 and is constructed taking into account its two base shanks 12.1 in the form of a C profile. This construction of the component frame 12 makes it possible that only the lower compact unit 14.2 is connected to rolls 28 and drive means 25, wherein the upper compact unit 14.1 is free of drive and guidance means. This simplifies the construction expense for the apparatus 1 according to the invention as regards a lateral movement of the two compact units 14.1, 14.2 transversely to the direction of rolling W.

FIG. 7 shows another embodiment of the apparatus 1 according to the invention in a simplified side view in which the spray device 7 of a particular compact unit 14.1, 14.2 is arranged substantially parallel to the rolling stock transport line 8 and its multi-substance nozzles 16 are aligned in the direction of the axis of rotation 9*a* of the working roll 9. In this manner the operating fluid is directly applied onto a surface of the working roll 9. For a purposeful suction removal of oil mist or the like the suction removal device 10 is preferably arranged in the direction of rotation of the working roll 9 (indicated in FIG. 7 by the arrow "R") after or behind the spray device 7. This specifically means that in the case of the upper compact unit 14.1 the suction removal device 10 is arranged underneath the spray device 8 and in the case of the lower compact unit 14.2 the suction removal device 10 is arranged above the spray device 7. As regards the suction removal device 10 for the embodiment of FIG. 7, it is understood that it is connected by a connection line 20 to the mist suction removal device 22 in the same manner as was already explained for the embodiment of FIG. 1. Furthermore, it should be pointed out that in the embodiment of FIG. 7 the mechanical holder of the compact units 14.1, 14.2 as well as supplying them with the media of operating fluid and propellant gas as well as the control signals for the multi-substance nozzles can take place in the same manner as in the embodiment of FIG. 1 so that in order to avoid repetitions, the latter is referred to.

The apparatus 1 according to the invention is characterized by a compact construction for a space-saving arrangement of the spray device and of the suction removal device in combination with an improved maintenance friendliness and operating friendliness. The explained arrangement of the spray device 7 and the surface 10 in the smallest possible space makes possible a modernization or retrofitting of already existing systems. A purposeful controlling of the regulator 37 makes it possible to supply the operating fluid and/or a mixture of the operating fluid and propellant gas to the compact units 14.1, 14.2 while maintaining predetermined theoretical conditions for processing parameters of the rolling process and to also be able to use different types of operating fluids which can be contained in tanks 34.*n* of the operating fluid reservoir 34.

LIST OF REFERENCE NUMERALS

1 apparatus
2 rolling stock
3 inlet
4 cold rolling system
5 spray device
7 rolling stock transport line
8 working roller
9*a* axis of rotation
10 suction removal device
12 component frame
14.1 compact unit
14.2 compact unit
16 multi-substance nozzle
18 spray beam
19 valve box
20 connection line
22 mist suction removal device
23 condensate runoff
24 suction removal conduit
25 drive means
28 roll devices
32 medium supply line
34 operating fluid reservoir
34.*n* tanks
37 regulator
W rolling direction

The invention claimed is:

1. An apparatus located at an inlet (4) of a cold rolling system (5) for applying or removing by suction at least one operating fluid onto or from a rolling stock (2) transported along a transport line (8) in a rolling direction (W), the apparatus comprising at least one spray device (7) arranged above or below the rolling stock transport line (8) for applying an operating fluid at least one of onto a surface of the rolling stock and onto a surface of a working roll (9) of a cold rolling system (5) in contact with the rolling stock (2), and at least one suction removal device (10) arranged above or below the rolling stock transport line (8) on a side of the rolling stock transport line (8), the at least one spray device (7) being arranged and in vicinity of the at least one of the surface of the rolling stock (2) and the surface of the working roll (9), characterized in that the at least one spray device (7) and the at least one suction removal device (10) are arranged on a common component frame (12) immediately adjacent to each other, thereby forming a compact unit (14.1, 14.2), wherein the common component frame (12) is distinct from a separate apparatus frame, wherein the at least one spray device (7) has at least one spray bar (18) with a plurality of multi-substance nozzles (16) each for discharging an operating fluid and propellant gas on the at least one of the surface of the rolling stock (2) and the surface of the working roll (9), and wherein the spray bar is arranged transversely to the rolling direction (W).

2. The apparatus according to claim 1, characterized in that for applying the operating fluid onto the surface of the rolling stock, the at least one suction device (10) is arranged, in the rolling direction (W), downstream of the spray device (7).

3. The apparatus according to claim 1, characterized in that for applying the operating fluid onto the surface of the working roll, the suction removal device (10) is arranged, viewing in a direction of rotation (R) of the working roll (9), after the spray device (7), and the spray device (7) is arranged substantially parallel to the rolling stock transport line (8) and is aligned with an exit opening thereof in direction of an axis of rotation (9*a*) of the working roll (9).

4. The apparatus according to claim 1, characterized in that the multi-substance nozzles (16) are controlled one of individually, in pairs, and as a group associated with a certain zone of the rolling stock (2) over its width.

5. The apparatus according to claim 1, characterized in that the spray device (7) is associated with a valve box (19) in which a plurality of control valves is provided for supplying the multi-substance nozzles (16) with a mixture of the operating fluid and the propellant gas.

6. An apparatus located at an inlet (4) of a cold rolling system (5) for applying or removing by suction at least one operating fluid onto or from a rolling stock (2) transported along a transport line (8) in a rolling direction (W), the apparatus comprising at least one spray device (7) arranged above or below the rolling stock transport line (8) for applying an operating fluid at least one of onto a surface of the rolling stock and onto a surface of a working roll (9) of cold rolling system (5) in contact with the rolling stock (2), and at least one suction removal device (10) arranged above or below the rolling stock transport line (8) on a side of the rolling stock transport line (8) the at least one spray device (7) is arranged and in vicinity of the at least one of the surface of the rolling stock (2) and the surface of the working roll (9), characterized in that the at least one spray device (7) and the at least one suction removal device (10) are arranged on a common component frame (12) of the apparatus, forming a compact unit (14.1; 14.2), and wherein the suction removal device (10) has a flow connection with a mist suction removal device (22) via a connection line (20), wherein the apparatus further comprises a condensate runoff (23), and wherein the condensate runoff (23) is arranged inside one of the mist suction removal device (22), the connection line (20), and a suction removal conduit (24) connected to the mist suction removal device (22).

7. An apparatus located at an inlet (4) of a cold rolling system (5) for applying or removing by suction at least one operating fluid onto or from a rolling stock (2) transported along a transport line (8) in a rolling direction (W), the apparatus comprising at least one spray device (7) arranged above or below the rolling stock transport line (8) for applying an operating fluid at least one of onto a surface of the rolling stock and onto a surface of a working roll (9) of the cold rolling system (5) in contact with the rolling stock (2), and at least one suction removal device (10) arranged above or below the rolling stock transport line (8) on a side of the rolling stock transport line (8) the at least one spray device (7) is arranged and in vicinity of the at least one of the surface of the rolling stock (2) and the surface of the working roll (9), characterized in that the at least one spray device (7) and the at least one suction removal device (10) are arranged on a common component frame (12) of apparatus, forming a compact unit (14.1, 14.2), wherein the apparatus further comprises drive means (25) for displacing the compact unit (14.1, 14.2) transversely to the rolling direction (W) between operating and non-operating positions, and wherein the at least one spray device (7) and the at least one suction removal device (10) are arranged sidewise of the rolling stock transport line (8) in the non-operating position of the compact unit (14.1, 14.2).

8. An apparatus located at an inlet (4) of a cold rolling system (5) for applying or removing by suction at least one operating fluid onto or from a rolling stock (2) transported along a transport line (8) in a rolling direction (W), the apparatus comprising at least one spray device (7) arranged above or below the rolling stock transport line (8) for applying an operating fluid at least one of onto a surface of the rolling stock and onto a surface of a working roll (9) of the cold rolling system (5) in contact with the rolling stock (2), and at least one suction removal device (10) arranged above or below the rolling stock transport line (8) on a side of the rolling stock transport line (8) the at least one spray device (7) is arranged and in vicinity of the at least one of the surface of the rolling stock (2) and the surface of the working roll (9), characterized in that the at least one spray device (7) and the at least one suction removal device (10) are arranged on a common component frame (12) immediately adjacent to each other, thereby forming a compact unit (14.1, 14.2), wherein the compact unit (14.1, 14.2) is provided with one of roll guide device (28) and wheel rail system for displacing the compact unit (14.1, 14.2) transverse to the rolling direction (W).

9. An apparatus located at an inlet (4) of a cold rolling system (5) for applying or removing by suction at least one operating fluid onto or from a rolling stock (2) transported along a transport line (8) in a rolling direction (W), the apparatus comprising at least one spray device (7) arranged above or below the rolling stock transport line (8) for applying an operating fluid at least one of onto a surface of the rolling stock and onto a surface of a working roll (9) of the cold rolling system (5) in contact with the rolling stock (2), and at least one suction removal device (10) arranged above or below the rolling stock transport line (8) on a side of the rolling stock transport line (8) the at least one spray device (7) is arranged and in vicinity of the at least one of the surface of the rolling stock (2) and the surface of the working roll (9), characterized in that the at least one spray device (7) and the at least one suction removal device (10) are arranged on a common component frame (12) immediately adjacent to each other, thereby forming a compact unit (14.1, 14.2), wherein the operating fluid is oil, and the at least one spray device (7) is connected to at least one oil reservoir (34) by at last one oil supply line (32), and wherein the oil reservoir (34) has a plurality of tanks (34), and the at least one spray device (7) is selectively connectable with a certain tank of the oil reservoir (34).

10. The apparatus according to claim 9, characterized in that the at least one of the at least one spray device (7) and the at least one suction removal device (10) is connected by control technology to a regulator (37) so that a discharge of the at least one of the operating fluid and of the propellant gas from the at least one spray device (7) and removal by suction of the operating fluid by the at least one suction removal device (10) takes place as a function of process parameters, and that the regulator is connected by signal technology to a process databank (39) so that the process parameters stored in the process databank (39) are read into the regulator (37).

11. An apparatus located at an inlet (4) of a cold rolling system (5) for applying or removing by suction at least one operating fluid onto or from a rolling stock (2) transported along a transport line (8) in a rolling direction (W), the apparatus comprising a first spray device (7) and second spray device (7) arranged, respectively, above or below the rolling stock transport line (8) for applying the operating fluid at least one of onto a surface of the rolling stock and onto a surface of a working roll (9) of the cold rolling system (5) in contact with the rolling stock (2), and first suction removal device (10) and second suction removal device (10) arranged, respectively, above and below the rolling stock transport line (8) on a side of the rolling stock transport line (8) the respective spray device (7) is arranged and in vicinity of the at least one of the surface of the rolling stock (2) and the surface of the working roll (9), characterized in that the at least one spray device (7) and the at least one suction removal device (10) and the second spray device (7) and second suction removal device (10) are arranged, respectively, on first component frame (12) and second component frame (12) forming, respectively, first component unit (14.1) and second component unit (14.2) provided, respectively, above and below the rolling stock transport line (8).

12. The apparatus according to claim 11, characterized in that the first and second compact units (14.1, 14.2) are connected by a connection element in the form of a C bracket so that only the compact unit (14.2) arranged below the rolling stock transport line (8) is connected to drive means (25) and is provided with the guide means (28).

* * * * *